US010665959B2

(12) United States Patent
Paulotto et al.

(10) Patent No.: US 10,665,959 B2
(45) Date of Patent: May 26, 2020

(54) MILLIMETER WAVE ANTENNAS HAVING DUAL PATCH RESONATING ELEMENTS

(71) Applicant: Apple Inc., Cupertino, CA (US)

(72) Inventors: Simone Paulotto, Redwood City, CA (US); Basim H. Noori, San Jose, CA (US); Matthew A. Mow, Los Altos, CA (US)

(73) Assignee: Apple Inc., Cupertino, CA (US)

( * ) Notice: Subject to any disclaimer, the term of this patent is extended or adjusted under 35 U.S.C. 154(b) by 86 days.

(21) Appl. No.: 15/658,141

(22) Filed: Jul. 24, 2017

(65) Prior Publication Data

US 2019/0027838 A1 Jan. 24, 2019

(51) Int. Cl.
*H01Q 21/06* (2006.01)
*H01Q 1/48* (2006.01)
(Continued)

(52) U.S. Cl.
CPC ..... *H01Q 21/065* (2013.01); *H01Q 1/2266* (2013.01); *H01Q 1/243* (2013.01);
(Continued)

(58) Field of Classification Search
CPC ..... H01Q 21/0006; H01Q 21/0025; H01Q 21/065; H01Q 21/22; H01Q 5/335; H01Q 9/0407
See application file for complete search history.

(56) References Cited

U.S. PATENT DOCUMENTS 4,356,492 A * 10/1982 Kaloi ..... H01Q 21/30 343/700 MS
7,595,759 B2 9/2009 Schlub et al.
(Continued)

FOREIGN PATENT DOCUMENTS

JP 2017085289 A 5/2017
KR 101014347 B1 2/2011

OTHER PUBLICATIONS

Low et al., "Dual Patches Microstrip Fed Antenna with Wide Bandwidth" Loughborough Antennas & Propagation Conference, Loughborough, UK, Nov. 2009, 978-1-4244-2721-5109, IEEE.
(Continued)

*Primary Examiner* — Dameon E Levi
*Assistant Examiner* — Jennifer F Hu
(74) *Attorney, Agent, or Firm* — Treyz Law Group, P.C.; Michael H. Lyons; Tianyi He

(57) ABSTRACT

An electronic device may be provided with millimeter wave transceiver circuitry and an antenna having a ground and a resonating element. The resonating element may include first and second patches symmetrically distributed about an axis. The antenna may be fed using an antenna feed having a first feed terminal coupled to both the first and second patches and a second feed terminal coupled to the ground. The first feed terminal may be coupled to the first patch at a side closest to the second patch and may be coupled to the second patch at a side closest to the first patch. The first and second patches may be shorted to the ground if desired. Antenna currents on the first patch may be 180 degrees out of phase with antenna currents on the second patch. The antenna may be arranged in an array of antennas with different polarizations.

16 Claims, 11 Drawing Sheets

(51) Int. Cl.

| | |
|---|---|
| ***H01Q 5/335*** | (2015.01) |
| ***H01Q 5/385*** | (2015.01) |
| ***H01Q 1/22*** | (2006.01) |
| ***H01Q 1/24*** | (2006.01) |
| ***H01Q 21/08*** | (2006.01) |
| ***H01Q 9/04*** | (2006.01) |
| ***H01Q 21/28*** | (2006.01) |
| ***H01Q 21/24*** | (2006.01) |
| ***H01Q 1/38*** | (2006.01) |
| ***H01Q 21/00*** | (2006.01) |
| ***H01Q 21/22*** | (2006.01) |

(52) U.S. Cl.

CPC ..... *H01Q 1/38* (2013.01); *H01Q 1/48* (2013.01); *H01Q 5/335* (2015.01); *H01Q 5/385* (2015.01); *H01Q 9/045* (2013.01); *H01Q 21/08* (2013.01); *H01Q 21/24* (2013.01); *H01Q 21/28* (2013.01); *H01Q 1/242* (2013.01); *H01Q 21/0025* (2013.01); *H01Q 21/22* (2013.01)

(56) References Cited

U.S. PATENT DOCUMENTS

| | | | | |
|---|---|---|---|---|
| 8,102,330 | B1 | 1/2012 | Albers | |
| 9,583,837 | B2 | 2/2017 | Xue et al. | |
| 2001/0028325 | A1* | 10/2001 | Pretorius | H01Q 1/38 343/700 MS |
| 2004/0222924 | A1* | 11/2004 | Dean | C08L 101/12 343/700 MS |
| 2005/0110685 | A1 | 5/2005 | Frederik du Toit | |
| 2006/0267844 | A1 | 11/2006 | Yanagi et al. | |
| 2008/0036662 | A1* | 2/2008 | Iwata | H01Q 9/0407 343/700 MS |
| 2008/0316121 | A1 | 12/2008 | Hobson et al. | |
| 2009/0256777 | A1* | 10/2009 | Nagai | H01Q 9/0407 343/893 |
| 2010/0177012 | A1* | 7/2010 | Morrow | H01Q 21/0025 343/893 |
| 2013/0050056 | A1 | 2/2013 | Lee et al. | |
| 2014/0062593 | A1 | 3/2014 | Gilbert | |
| 2014/0203995 | A1 | 7/2014 | Romney et al. | |
| 2014/0210486 | A1 | 7/2014 | Dijkstra | |
| 2015/0192724 | A1 | 7/2015 | Yepes et al. | |
| 2015/0194730 | A1 | 7/2015 | Sudo et al. | |
| 2015/0333407 | A1 | 11/2015 | Yamagajo et al. | |
| 2017/0110787 | A1 | 4/2017 | Ouyang et al. | |
| 2017/0117754 | A1 | 4/2017 | Noori et al. | |
| 2017/0256867 | A1 | 9/2017 | Ding et al. | |
| 2018/0076530 | A1* | 3/2018 | Kawahata | H01Q 21/08 |
| 2018/0159203 | A1 | 6/2018 | Baks et al. | |
| 2018/0198204 | A1 | 7/2018 | Kovacic | |

OTHER PUBLICATIONS

Paulotto et al., U.S. Appl. No. 15/650,627, filed Jul. 14, 2017.
Paulotto et al., U.S. Appl. No. 15/650,638, filed Jul. 14, 2017.
Paulotto et al., U.S. Appl. No. 15/650,689, filed Jul. 14, 2017.
Paulotto et al., U.S. Appl. No. 15/659,503, filed Jul. 25, 2017.
Mow et al., U.S. Appl. No. 15/217,805, filed Jul. 22, 2017.
Noori et al., U.S. Appl. No. 15/138,689, filed Apr. 26, 2016.
Noori et al., U.S. Appl. No. 15/138,684, filed Apr. 26, 2016.

* cited by examiner

MILLIMETER WAVE ANTENNAS HAVING DUAL PATCH RESONATING ELEMENTS

BACKGROUND

This relates generally to electronic devices and, more particularly, to electronic devices with wireless communications circuitry.

Electronic devices often include wireless communications circuitry. For example, cellular telephones, computers, and other devices often contain antennas and wireless transceivers for supporting wireless communications.

It may be desirable to support wireless communications in millimeter wave and centimeter wave communications bands. Millimeter wave communications, which are sometimes referred to as extremely high frequency (EHF) communications, and centimeter wave communications involve communications at frequencies of about 10-300 GHz. Operation at these frequencies may support high bandwidths but may raise significant challenges. For example, millimeter wave communications are often line-of-sight communications and can be characterized by substantial attenuation during signal propagation.

It would therefore be desirable to be able to provide electronic devices with improved wireless communications circuitry such as communications circuitry that supports communications at frequencies greater than 10 GHz.

SUMMARY

An electronic device may be provided with wireless circuitry. The wireless circuitry may include an antenna and transceiver circuitry such as millimeter wave transceiver circuitry.

The antenna may include an antenna ground and an antenna resonating element. The transceiver circuitry may transmit and receive antenna signals between 10 GHz and 300 GHz using the antenna. The antenna resonating element may be formed above the antenna ground and may include first and second conductive patches symmetrically distributed about an axis (e.g., the first and second patches may have the same dimensions and may be mirrored about an axis running between the first and second patches).

A transmission line may be formed from a conductive trace and a portion of the antenna ground. The antenna may be fed using an antenna feed having a first feed terminal coupled to the conductive trace and a second feed terminal coupled to the antenna ground. The first feed terminal may be coupled to both the first and second patches. Antenna signals may be conveyed by the transmission line and over the first and second patches through the first feed terminal. For example, the first feed terminal may be coupled to the first patch at a side of the first patch that is closest to the second patch (e.g., over a first conductive via) and may be coupled to the second patch at a side of the second patch that is closest to the first patch (e.g., over a second conductive via). When configured in this way, antenna currents that flow over the first patch may be 180 degrees out of phase with respect to antenna currents that flow over the second patch. If desired, the end of the first patch farthest from the second patch and the end of the second patch farthest from the first patch may be shorted to the antenna ground using conductive vias.

The antenna may be arranged in a one-dimensional array with other antennas having pairs of patches that are symmetrically distributed about the same axis. In order to enhance polarization diversity, multiple one-dimensional arrays of these antennas may be provided at different orientations on a substrate. In another suitable arrangement, the antenna may be arranged in a two-dimensional array with other antennas having pairs of patches that are symmetrically distributed about a perpendicular axis. Control circuitry may perform beam steering operations using the arrays.

DETAILED DESCRIPTION

Figure 1:
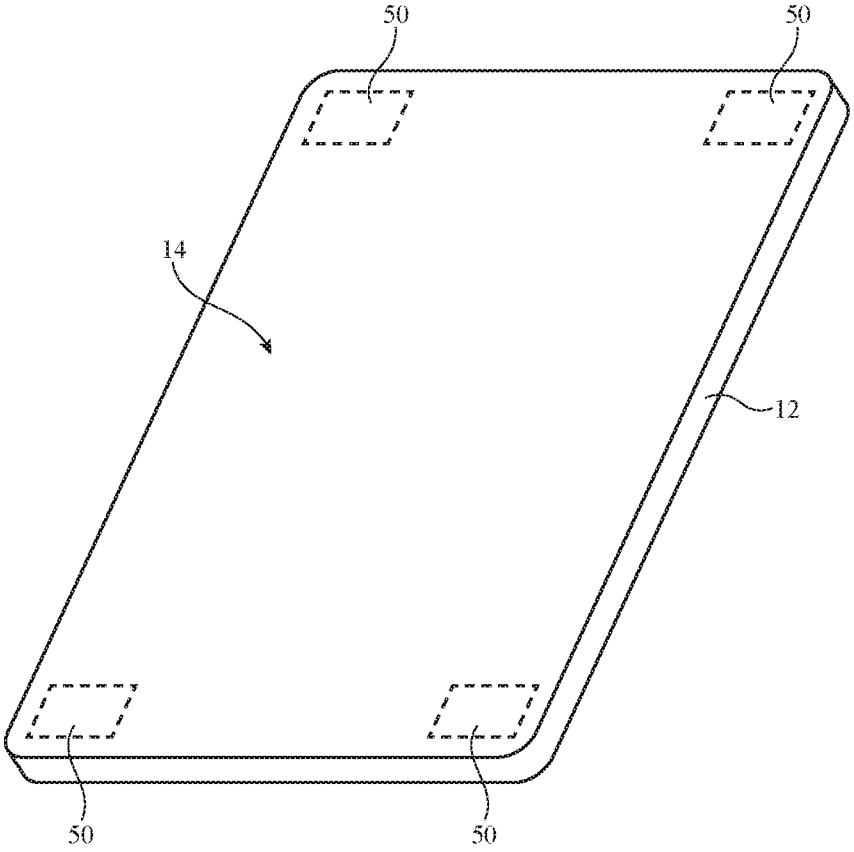
FIG. 1 is a perspective view of an illustrative electronic device with wireless communications circuitry in accordance with an embodiment.

An electronic device such as electronic device 10 of FIG. 1 may contain wireless circuitry. The wireless circuitry may include one or more antennas. The antennas may include phased antenna arrays that are used for handling millimeter wave and centimeter wave communications. Millimeter wave communications, which are sometimes referred to as extremely high frequency (EHF) communications, involve signals at 60 GHz or other frequencies between about 30 GHz and 300 GHz. Centimeter wave communications involve signals at frequencies between about 10 GHz and 30 GHz. If desired, device 10 may also contain wireless communications circuitry for handling satellite navigation system signals, cellular telephone signals, local wireless area network signals, near-field communications, light-based wireless communications, or other wireless communications.

Electronic device 10 may be a computing device such as a laptop computer, a computer monitor containing an embedded computer, a tablet computer, a cellular telephone, a media player, or other handheld or portable electronic device, a smaller device such as a wristwatch device, a pendant device, a headphone or earpiece device, a virtual or augmented reality headset device, a device embedded in eyeglasses or other equipment worn on a user's head, or other wearable or miniature device, a television, a computer display that does not contain an embedded computer, a gaming device, a navigation device, an embedded system such as a system in which electronic equipment with a display is mounted in a kiosk or automobile, a wireless access point or base station, a desktop computer, a keyboard, a gaming controller, a computer mouse, a mousepad, a trackpad or touchpad, equipment that implements the functionality of two or more of these devices, or other electronic equipment. In the illustrative configuration of FIG. 1, device 10 is a portable device such as a cellular telephone, media player, tablet computer, or other portable computing device. Other configurations may be used for device 10 if desired. The example of FIG. 1 is merely illustrative.

As shown in FIG. 1, device 10 may include a display such as display 14. Display 14 may be mounted in a housing such as housing 12. Housing 12, which may sometimes be referred to as an enclosure or case, may be formed of plastic, glass, ceramics, fiber composites, metal (e.g., stainless steel, aluminum, etc.), other suitable materials, or a combination of any two or more of these materials. Housing 12 may be formed using a unibody configuration in which some or all of housing 12 is machined or molded as a single structure or may be formed using multiple structures (e.g., an internal frame structure, one or more structures that form exterior housing surfaces, etc.).

Display 14 may be a touch screen display that incorporates a layer of conductive capacitive touch sensor electrodes or other touch sensor components (e.g., resistive touch sensor components, acoustic touch sensor components, force-based touch sensor components, light-based touch sensor components, etc.) or may be a display that is not touch-sensitive. Capacitive touch screen electrodes may be formed from an array of indium tin oxide pads or other transparent conductive structures.

Display 14 may include an array of display pixels formed from liquid crystal display (LCD) components, an array of electrophoretic display pixels, an array of plasma display pixels, an array of organic light-emitting diode display pixels, an array of electrowetting display pixels, or display pixels based on other display technologies.

Display 14 may be protected using a display cover layer such as a layer of transparent glass, clear plastic, sapphire, or other transparent dielectric. Openings may be formed in the display cover layer. For example, openings may be formed in the display cover layer to accommodate one or more buttons, sensor circuitry such as a fingerprint sensor or light sensor, ports such as a speaker port or microphone port, etc. Openings may be formed in housing 12 to form communications ports (e.g., an audio jack port, a digital data port, charging port, etc.). Openings in housing 12 may also be formed for audio components such as a speaker and/or a microphone.

Antennas may be mounted in housing 12. If desired, some of the antennas (e.g., antenna arrays that may implement beam steering, etc.) may be mounted under an inactive border region of display 14 (see, e.g., illustrative antenna locations 50 of FIG. 1). Display 14 may contain an active area with an array of pixels (e.g., a central rectangular portion). Inactive areas of display 14 are free of pixels and may form borders for the active area. If desired, antennas may also operate through dielectric-filled openings in the rear of housing 12 or elsewhere in device 10.

To avoid disrupting communications when an external object such as a human hand or other body part of a user blocks one or more antennas, antennas may be mounted at multiple locations in housing 12. Sensor data such as proximity sensor data, real-time antenna impedance measurements, signal quality measurements such as received signal strength information, and other data may be used in determining when one or more antennas is being adversely affected due to the orientation of housing 12, blockage by a user's hand or other external object, or other environmental factors. Device 10 can then switch one or more replacement antennas into use in place of the antennas that are being adversely affected.

Antennas may be mounted at the corners of housing 12 (e.g., in corner locations 50 of FIG. 1 and/or in corner locations on the rear of housing 12), along the peripheral edges of housing 12, on the rear of housing 12, under the display cover glass or other dielectric display cover layer that is used in covering and protecting display 14 on the front of device 10, under a dielectric window on a rear face of housing 12 or the edge of housing 12, or elsewhere in device 10.

Figure 2:
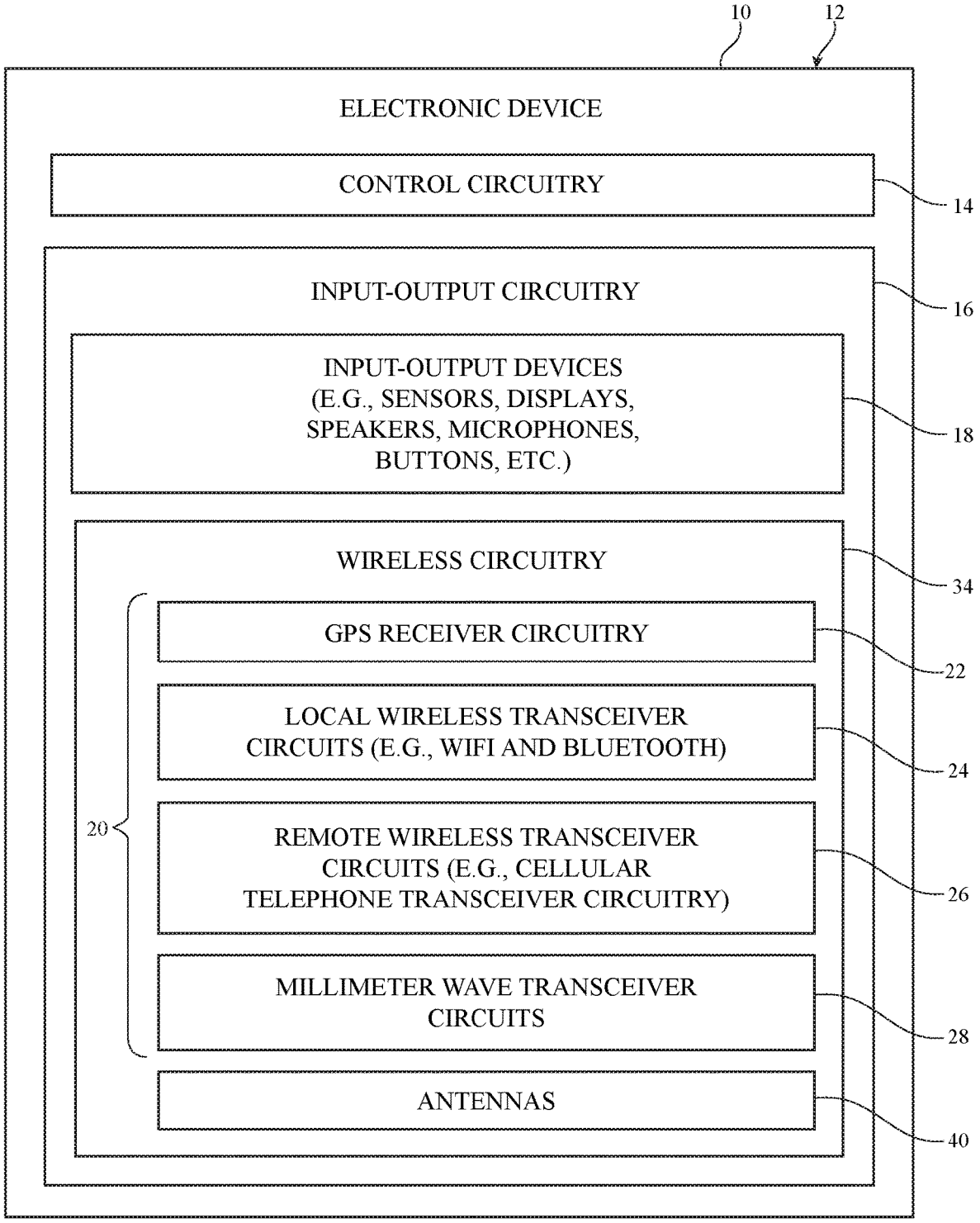
FIG. 2 is a schematic diagram of an illustrative electronic device with wireless communications circuitry in accordance with an embodiment.

A schematic diagram showing illustrative components that may be used in device 10 is shown in FIG. 2. As shown in FIG. 2, device 10 may include storage and processing circuitry such as control circuitry 14. Control circuitry 14 may include storage such as hard disk drive storage, nonvolatile memory (e.g., flash memory or other electrically-programmable-read-only memory configured to form a solid state drive), volatile memory (e.g., static or dynamic random-access-memory), etc. Processing circuitry in control circuitry 14 may be used to control the operation of device 10. This processing circuitry may be based on one or more microprocessors, microcontrollers, digital signal processors, baseband processor integrated circuits, application specific integrated circuits, etc.

Control circuitry 14 may be used to run software on device 10, such as internet browsing applications, voice-over-internet-protocol (VOIP) telephone call applications, email applications, media playback applications, operating system functions, etc. To support interactions with external equipment, control circuitry 14 may be used in implementing communications protocols. Communications protocols that may be implemented using control circuitry 14 include internet protocols, wireless local area network protocols (e.g., IEEE 802.11 protocols—sometimes referred to as WiFi®), protocols for other short-range wireless communications links such as the Bluetooth® protocol or other WPAN protocols, IEEE 802.11ad protocols, cellular telephone protocols, MIMO protocols, antenna diversity protocols, satellite navigation system protocols, $5^{th}$ generation mobile networks or $5^{th}$ generation wireless systems (5G) protocols, etc.

Device 10 may include input-output circuitry 16. Input-output circuitry 16 may include input-output devices 18. Input-output devices 18 may be used to allow data to be supplied to device 10 and to allow data to be provided from device 10 to external devices. Input-output devices 18 may include user interface devices, data port devices, and other input-output components. For example, input-output devices may include touch screens, displays without touch sensor capabilities, buttons, joysticks, scrolling wheels, touch pads, key pads, keyboards, microphones, cameras, speakers, status indicators, light sources, audio jacks and other audio port components, digital data port devices, light sensors, accelerometers or other components that can detect motion and device orientation relative to the Earth, capacitance sensors, proximity sensors (e.g., a capacitive proximity sensor and/or an infrared proximity sensor), magnetic sensors, and other sensors and input-output components.

Input-output circuitry 16 may include wireless communications circuitry 34 for communicating wirelessly with external equipment. Wireless communications circuitry 34 may include radio-frequency (RF) transceiver circuitry formed from one or more integrated circuits, power amplifier circuitry, low-noise input amplifiers, passive RF components, one or more antennas 40, transmission lines, and other circuitry for handling RF wireless signals. Wireless signals can also be sent using light (e.g., using infrared communications).

Wireless communications circuitry 34 may include transceiver circuitry 20 for handling various radio-frequency communications bands. For example, circuitry 34 may include transceiver circuitry 22, 24, 26, and 28.

Transceiver circuitry 24 may be wireless local area network (WLAN) transceiver circuitry. Transceiver circuitry 24 may handle 2.4 GHz and 5 GHz bands for WiFi® (IEEE 802.11) communications and may handle the 2.4 GHz Bluetooth® communications band.

Circuitry 34 may use cellular telephone transceiver circuitry 26 for handling wireless communications in frequency ranges such as a communications band from 700 to 960 MHz, a communications band from 1710 to 2170 MHz, and a communications from 2300 to 2700 MHz or other communications bands between 600 MHz and 4000 MHz or other suitable frequencies (as examples). Circuitry 26 may handle voice data and non-voice data.

Millimeter wave transceiver circuitry 28 (sometimes referred to as extremely high frequency (EHF) transceiver circuitry 28 or transceiver circuitry 28) may support communications at frequencies between about 10 GHz and 300 GHz. For example, transceiver circuitry 28 may support communications in Extremely High Frequency (EHF) or millimeter wave communications bands between about 30 GHz and 300 GHz and/or in centimeter wave communications bands between about 10 GHz and 30 GHz (sometimes referred to as Super High Frequency (SHF) bands). As examples, transceiver circuitry 28 may support communications in an IEEE K communications band between about 18 GHz and 27 GHz, a $K_a$ communications band between about 26.5 GHz and 40 GHz, a $K_u$ communications band between about 12 GHz and 18 GHz, a V communications band between about 40 GHz and 75 GHz, a W communications band between about 75 GHz and 110 GHz, or any other desired frequency band between approximately 10 GHz and 300 GHz. If desired, circuitry 28 may support IEEE 802.11ad communications at 60 GHz and/or $5^{th}$ generation mobile networks or $5^{th}$ generation wireless systems (5G) communications bands between 27 GHz and 90 GHz. If desired, circuitry 28 may support communications at multiple frequency bands between 10 GHz and 300 GHz such as a first band from 27.5 GHz to 28.5 GHz, a second band from 37 GHz to 41 GHz, and a third band from 57 GHz to 71 GHz, or other communications bands between 10 GHz and 300 GHz. Circuitry 28 may be formed from one or more integrated circuits (e.g., multiple integrated circuits mounted on a common printed circuit in a system-in-package device, one or more integrated circuits mounted on different substrates, etc.). While circuitry 28 is sometimes referred to herein as millimeter wave transceiver circuitry 28, millimeter wave transceiver circuitry 28 may handle communications at any desired communications bands at frequencies between 10 GHz and 300 GHz (e.g., in millimeter wave communications bands, centimeter wave communications bands, etc.).

Wireless communications circuitry 34 may include satellite navigation system circuitry such as Global Positioning System (GPS) receiver circuitry 22 for receiving GPS signals at 1575 MHz or for handling other satellite positioning data (e.g., GLONASS signals at 1609 MHz). Satellite navigation system signals for receiver 22 are received from a constellation of satellites orbiting the earth.

In satellite navigation system links, cellular telephone links, and other long-range links, wireless signals are typically used to convey data over thousands of feet or miles. In WiFi® and Bluetooth® links at 2.4 and 5 GHz and other short-range wireless links, wireless signals are typically used to convey data over tens or hundreds of feet. Extremely high frequency (EHF) wireless transceiver circuitry 28 may convey signals over these short distances that travel between transmitter and receiver over a line-of-sight path. To enhance signal reception for millimeter and centimeter wave communications, phased antenna arrays and beam steering techniques may be used (e.g., schemes in which antenna signal phase and/or magnitude for each antenna in an array is adjusted to perform beam steering). Antenna diversity schemes may also be used to ensure that the antennas that have become blocked or that are otherwise degraded due to the operating environment of device 10 can be switched out of use and higher-performing antennas used in their place.

Wireless communications circuitry 34 can include circuitry for other short-range and long-range wireless links if desired. For example, wireless communications circuitry 34 may include circuitry for receiving television and radio signals, paging system transceivers, near field communications (NFC) circuitry, etc.

Antennas 40 in wireless communications circuitry 34 may be formed using any suitable antenna types. For example, antennas 40 may include antennas with resonating elements that are formed from patch antenna structures (e.g., symmetric dual patches that are fed using a single feed terminal and that are optionally shorted to ground), loop antenna structures, inverted-F antenna structures, slot antenna structures, planar inverted-F antenna structures, monopole antenna structures, dipole antenna structures, helical antenna structures, Yagi (Yagi-Uda) antenna structures, hybrids of these designs, etc. If desired, one or more of antennas 40 may be cavity-backed antennas. Different types of antennas may be used for different bands and combinations of bands. For example, one type of antenna may be used in forming a local wireless link antenna and another type of antenna may be used in forming a remote wireless link antenna. Dedicated antennas may be used for receiving satellite navigation system signals or, if desired, antennas 40 can be configured to receive both satellite navigation system signals and signals for other communications bands (e.g., wireless local area network signals and/or cellular telephone signals). Antennas 40 can one or more antennas such as antennas arranged in one or more phased antenna arrays for handling millimeter and centimeter wave communications.

Transmission line paths may be used to route antenna signals within device 10. For example, transmission line paths may be used to couple antenna structures 40 to transceiver circuitry 20. Transmission lines in device 10 may include coaxial probes realized by metal vias, microstrip transmission lines, stripline transmission lines, edge-coupled microstrip transmission lines, edge-coupled stripline transmission lines, waveguide structures, transmission lines formed from combinations of transmission lines of these types, etc. Filter circuitry, switching circuitry, impedance matching circuitry, and other circuitry may be interposed within the transmission lines, if desired.

In devices such as handheld devices, the presence of an external object such as the hand of a user or a table or other surface on which a device is resting has a potential to block wireless signals such as millimeter wave signals. Accordingly, it may be desirable to incorporate multiple antennas or phased antenna arrays into device 10, each of which is placed in a different location within device 10. With this type of arrangement, an unblocked antenna or phased antenna array may be switched into use. In scenarios where a phased antenna array is formed in device 10, once switched into use, the phased antenna array may use beam steering to optimize wireless performance. Configurations in which antennas from one or more different locations in device 10 are operated together may also be used.

Figure 3:
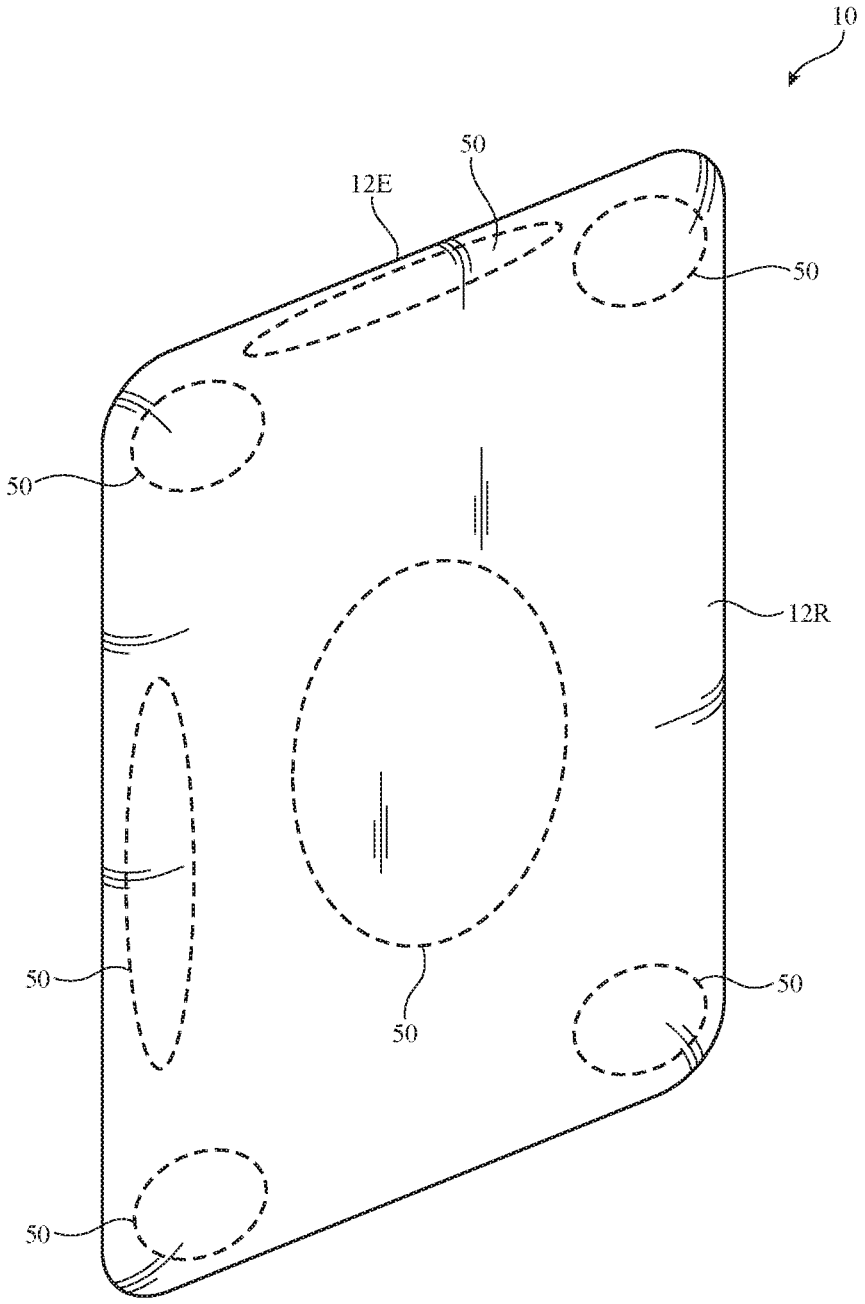
FIG. 3 is a rear perspective view of an illustrative electronic device showing illustrative locations at which antennas for communications at frequencies greater than 10 GHz may be located in accordance with an embodiment.

FIG. 3 is a perspective view of electronic device 10 showing illustrative locations 50 on the rear of housing 12 in which antennas 40 (e.g., single antennas and/or phased antenna arrays for use with wireless circuitry 34 such as wireless transceiver circuitry 28) may be mounted in device 10. Antennas 40 may be mounted at the corners of device 10, along the edges of housing 12 such as edge 12E, on upper and lower portions of rear housing portion (wall) 12R, in the center of rear housing wall 12R (e.g., under a dielectric window structure or other antenna window in the center of rear housing 12R), at the corners of rear housing wall 12R (e.g., on the upper left corner, upper right corner, lower left corner, and lower right corner of the rear of housing 12 and device 10), etc.

In configurations in which housing 12 is formed entirely or nearly entirely from a dielectric, antennas 40 may transmit and receive antenna signals through any suitable portion of the dielectric. In configurations in which housing 12 is formed from a conductive material such as metal, regions of the housing such as slots or other openings in the metal may be filled with plastic or other dielectric. Antennas 40 may be mounted in alignment with the dielectric in the openings. These openings, which may sometimes be referred to as dielectric antenna windows, dielectric gaps, dielectric-filled openings, dielectric-filled slots, elongated dielectric opening regions, etc., may allow antenna signals to be transmitted to external equipment from antennas 40 mounted within the interior of device 10 and may allow internal antennas 40 to receive antenna signals from external equipment. In another suitable arrangement, antennas 40 may be mounted on the exterior of conductive portions of housing 12.

In devices with phased antenna arrays, circuitry 34 may include gain and phase adjustment circuitry that is used in adjusting the signals associated with each antenna 40 in an array (e.g., to perform beam steering). Switching circuitry may be used to switch desired antennas 40 into and out of use. Each of locations 50 may include multiple antennas 40 (e.g., a set of three antennas or more than three or fewer than three antennas in a phased antenna array) and, if desired, one or more antennas from one of locations 50 may be used in transmitting and receiving signals while using one or more antennas from another of locations 50 in transmitting and receiving signals.

Figure 4:
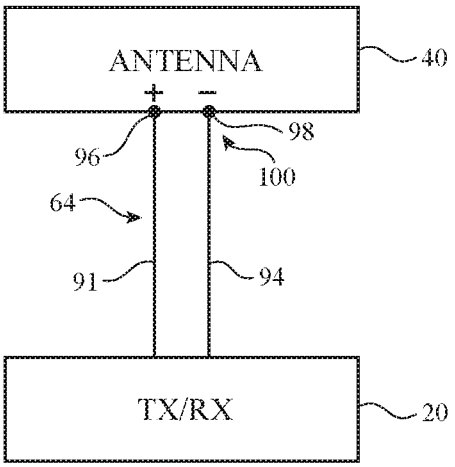
FIG. 4 is a diagram of illustrative transceiver circuitry and antenna in accordance with an embodiment.

A schematic diagram of an antenna 40 coupled to transceiver circuitry 20 (e.g., transceiver circuitry 28) is shown in FIG. 4. As shown in FIG. 4, radio-frequency transceiver circuitry 20 may be coupled to antenna feed 100 of antenna 40 using transmission line 64. Antenna feed 100 may include a positive antenna feed terminal such as positive antenna feed terminal 96 and may have a ground antenna feed terminal such as ground antenna feed terminal 98. Transmission line 64 may be formed form metal traces on a printed circuit or other conductive structures and may have a positive transmission line signal path such as path 91 that is coupled to terminal 96 and a ground transmission line signal path such as path 94 that is coupled to terminal 98. Transmission line paths such as path 64 may be used to route antenna signals within device 10. For example, transmission line paths may be used to couple antenna structures such as one or more antennas in an array of antennas to transceiver circuitry 20. Transmission lines in device 10 may include a coaxial probe realized by a metal via, coaxial cable paths, microstrip transmission lines, stripline transmission lines, edge-coupled microstrip transmission lines, edge-coupled stripline transmission lines, waveguide structures, transmission lines formed from combinations of transmission lines of these types, etc. Filter circuitry, switching circuitry, phase adjustment circuitry, amplifier circuitry, impedance matching circuitry, and other circuitry may be interposed within transmission line 64 and/or circuits such as these may be incorporated into antenna 40 if desired (e.g., to support antenna tuning, to support operation in desired frequency bands, etc.).

Device 10 may contain multiple antennas 40. The antennas may be used together or one of the antennas may be switched into use while other antenna(s) are switched out of use. If desired, control circuitry 14 may be used to select an optimum antenna to use in device 10 in real time and/or to select an optimum setting for adjustable wireless circuitry associated with one or more of antennas 40. Antenna adjustments may be made to tune antennas to perform in desired frequency ranges, to perform beam steering with a phased antenna array, and to otherwise optimize antenna performance. Sensors may be incorporated into antennas 40 to gather sensor data in real time that is used in adjusting antennas 40.

In some configurations, antennas 40 may be arranged in one or more antenna arrays (e.g., phased antenna arrays to implement beam steering functions). For example, the antennas that are used in handling millimeter and centimeter wave signals for wireless transceiver circuits 28 may be implemented as phased antenna arrays. The radiating elements in a phased antenna array for supporting millimeter and centimeter wave communications may be patch antennas (e.g., antennas having a resonating element with symmetric dual patches that are fed using a single feed terminal and that are optionally shorted to ground), dipole antennas, dipole antennas with directors and reflectors in addition to dipole antenna resonating elements (sometimes referred to as Yagi antennas or beam antennas), or other suitable antenna elements. Transceiver circuitry can be integrated with the phased antenna arrays to form integrated phased antenna array and transceiver circuit modules if desired.

Figure 5:
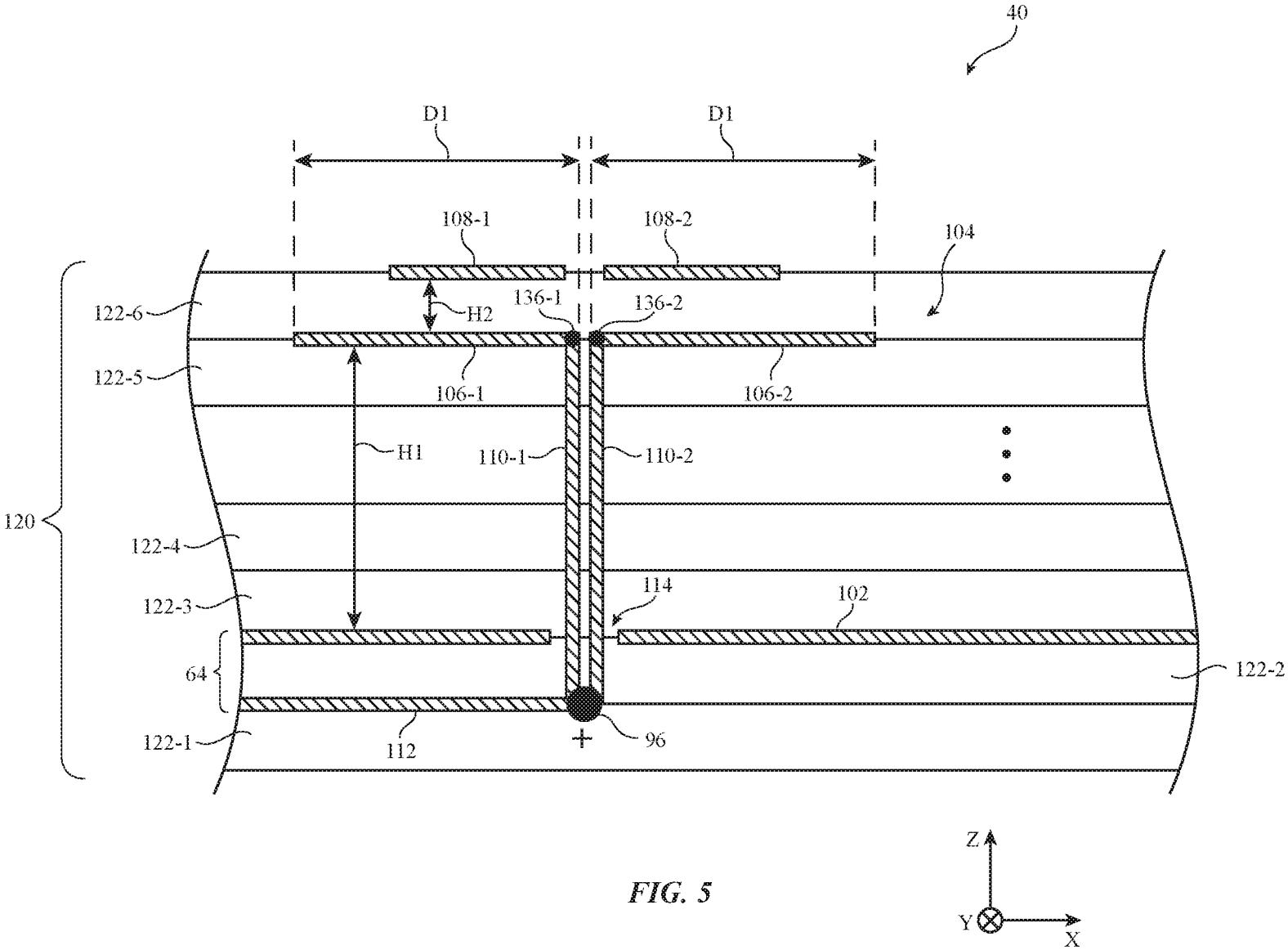
FIG. 5 is a cross-sectional side view of an illustrative antenna having a resonating element with dual patches that are fed over a single feed terminal in accordance with an embodiment.

FIG. 5 is a cross-sectional side view of an illustrative antenna 40 (e.g., a patch antenna having a resonating element with dual symmetric patches that are fed using a single feed terminal). As shown in FIG. 5, antenna 40 may include a ground plane 102 and a resonating element 104 that is separated from ground plane 102. Resonating element 104 may include conductive patches 106 separated from ground plane 102 by distance H1. Patches 106 may sometimes be referred to herein as conductors 106, planar conductors 106, or resonating element portions 106. Patches 106 and ground plane 102 may each have lateral surface areas in the X-Y plane of FIG. 5. The lateral surface area of patches 106 may extend parallel to the lateral surface area of ground plane 102. In the example of FIG. 5, resonating element 104 includes two symmetric patches 106-1 and 106-2. Patches 106-1 and 106-2 may sometimes be referred to herein as dual patches 106-1 and 106-2 and resonating element 104 may sometimes be referred to herein as dual patch antenna resonating element 104.

Ground feed terminal 98 of antenna feed 100 (FIG. 4) may be coupled to ground structures such as ground plane 102. Resonating element 104 may include conductive paths such as conductive paths 110 that are used to couple signal feed terminal 96 of antenna feed 100 to patches 106 of resonating element 104. Conductive paths 110 may be used to couple the same feed terminal 96 to multiple terminals (points) 136 on patches 106 so that antenna 40 is fed using transmission line 64 having a positive conductor coupled to terminal 96 and thus terminals 136.

In the example of FIG. 5, a first conductive path 110-1 may couple feed terminal 96 to terminal 136-1 on patch 106-1 whereas a second conductive path 110-2 couples the same feed terminal 96 to terminal 136-2 on patch 106-2. Antenna currents may be conveyed over patch 106-1 via feed terminal 96, path 110-1, and terminal 136-1 and may be conveyed over patch 106-2 via feed terminal 96, path 110-2, and terminal 136-2. When arranged in this way, the antenna currents flowing over patch 106-1 may be approximately 180 degrees out of phase with the antenna currents flowing over patch 106-2.

As shown in FIG. 5, antenna 40 may be formed on a dielectric substrate such as substrate 120. Substrate 120 may be, for example, a rigid or printed circuit board or other dielectric substrate. Substrate 120 may include multiple dielectric layers 122 (e.g., multiple layers of printed circuit board substrate such as multiple layers of fiberglass-filled epoxy) such as a first dielectric layer 122-1, a second dielectric layer 122-2 over the first dielectric layer, a third dielectric layer 122-3 over the second dielectric layer, a fourth dielectric layer 122-4 over the third dielectric layer, a fifth dielectric layer 122-5 over the fourth dielectric layer, and a sixth dielectric layer 122-6 over the fifth dielectric layer. Additional or fewer dielectric layers 122 may be stacked within substrate 120 if desired.

With this type of arrangement, antenna 40 may be embedded within the layers of substrate 120. For example, ground plane 102 may be formed on a surface of second layer 122-2, and conductive patches 106-1 and 106-2 may be formed on a surface of fifth layer 122-5 (e.g., distance H1 may be equal to the sum of the thicknesses of the layers 122 between patches 106 and ground 102). Distance H1 may be between 0.1 mm and 10 mm, as an example. In general, adjusting distance H1 may serve to adjust the bandwidth of antenna 40, for example.

Antenna 40 may be fed using a transmission line such as transmission line 64. Transmission line 64 may, for example, be formed from a conductive trace such as conductive trace 112 on layer 122-1 and portions of ground layer 102. Conductive trace 112 may form the positive signal conductor for transmission line 64, for example. A hole such as hole 114 (sometimes referred to as slot, gap, or opening 114) may be formed in ground layer 102. Conductive structures 110-1 and 110-2 may be, for example, conductive vias extending through layer 122-2, hole 114, and layers 122-3, 122-4, and 122-5 to terminal 136-1 on patch 106-1 and terminal 136-2 on patch 106-2, respectively. In other arrangements, conductive structures 110-1 and 110-2 may include conductive traces or other vertical conductive structures such as metal pillars, metal wires, conductive pins, etc.

Transmission line 64 may convey antenna signals for antenna 40 (e.g., to and from transceiver 20) such as antenna signals at frequencies between 10 GHz and 300 GHz (e.g., millimeter wave antenna signals such as signals in a band between 30 GHz and 300 GHz, signals in a band between 57 GHz and 71 GHz, etc.). Corresponding antenna currents may flow over feed terminal 96 through vertical conductor 110-1 to patch 106-1 and through vertical conductor 110-2 to patch 106-2. Patches 106-1 and 106-2 may each have the same lateral length D1 extending from terminals 136-1 and 136-2, respectively. Length D1 may, for example, be approximately equal to (e.g., within 15% of) one half of the wavelength of operation of antenna 40 (e.g., a wavelength corresponding to a frequency between 10 GHz and 300 GHz such as a centimeter or millimeter scale wavelength). If desired, length D1 may be equal to one half of the wavelength of operation of antenna 40 divided by the square root of the dielectric constant of the material used to form layers 122 (e.g., length D1 may be inversely proportional to the dielectric constant of substrate 120).

If desired, antenna 40 may include parasitic antenna resonating elements 108 such as a first parasitic antenna resonating element 108-1 formed over patch 106-1 and a second parasitic antenna resonating element 108-2 formed over patch 106-2. In the example of FIG. 5, parasitic antenna resonating elements 108-1 and 108-2 may be formed on a surface of dielectric layer 122-6 and may have lateral surface areas extending in the X-Y plane. Parasitic 108-1 and 108-2 may be separated from patch elements 106-1 and 106-2, respectively, by vertical distance H2 (e.g., the thickness of layer 122-6). Distance H2 may be less than, equal to, or greater than distance H1. Some or all of the lateral area of parasitic element 108-1 may overlap with the outline (footprint) of patch 106-1 whereas some or all of the lateral area of parasitic element 108-2 may overlap with the outline of patch 106-2 (e.g., in the X-Y plane).

Parasitic antenna resonating elements 108 may sometimes be referred to herein as parasitic resonating elements 108, parasitic antenna elements 108, parasitic elements 108, parasitic patches 108, parasitic conductors 108, parasitic structures 108, patches 108, or parasitics 108. Parasitic elements 108 are not directly fed (e.g., elements 108 are not electrically connected to any transmission lines 64), whereas patches 106-1 and 106-2 are directly fed via respective vertical conductors 110-1 and 110-2, a common (shared) signal feed terminal 96, and a common (shared) transmission line 64. Parasitic elements 108 may create a constructive perturbation of the electromagnetic field generated by patches 106-1 and 106-2, creating a new resonance for antenna 40. This may serve to broaden the overall bandwidth of antenna 40 (e.g., to cover the entire frequency band from 57 GHz to 71 GHz). The example of FIG. 5 is merely illustrative. If desired, a single parasitic element 108 may be formed over patches 106-1 and 106-2. Parasitic elements 108 may be omitted if desired.

Conductive patches 106-1 and 106-2, parasitic elements 108-1 and 108-2, and/or ground 102 may be formed from conductive (metal) traces on the corresponding layers 122 of substrate 120. The example of FIG. 5 is merely illustrative. If desired, additional layers 122 may be interposed between traces 112 and 102, and additional or fewer layers 122 may be interposed between traces 102 and traces 106 and/or between traces 106 and traces 108. In another suitable arrangement, substrate 120 may be formed from a single dielectric layer (e.g., antennas 40 may be embedded within a single dielectric layer such as a molded plastic layer). In yet another suitable arrangement, substrate 120 may be omitted and antenna 40 may be formed on other substrate structures or may be formed without substrates. If desired, parasitic elements 108, patches 106, and/or ground plane 102 may be formed from other conductive structures such as stamped sheet metal, metal foil, electronic device housing structures, or any other desired conductive structures if desired (e.g., in scenarios where substrate 120 is omitted or other substrates are used).

Figure 6:
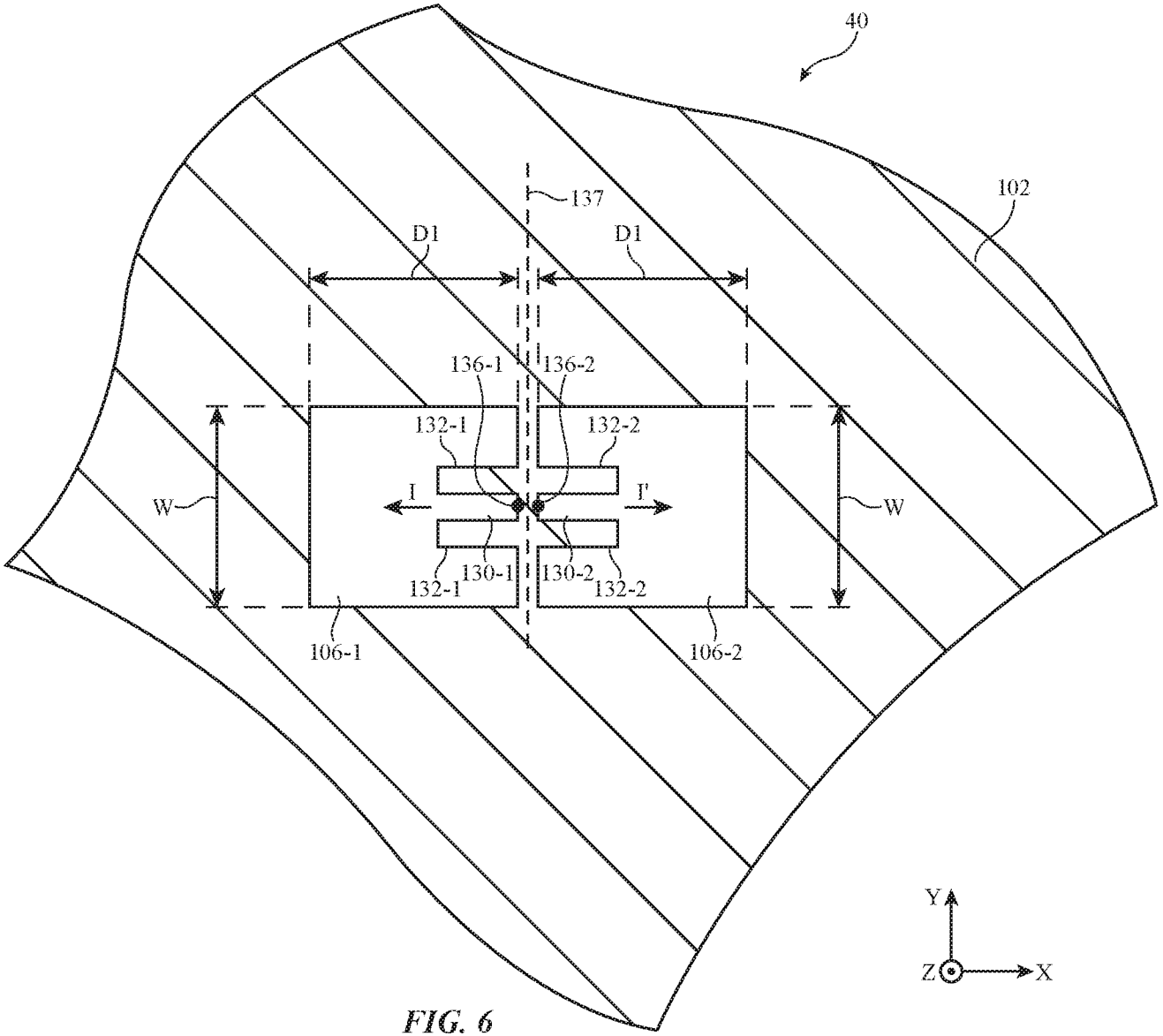
FIG. 6 is a top-down view of an illustrative antenna having a resonating element with dual patches that are fed over a single feed terminal in accordance with an embodiment.

FIG. 6 is a top-down view of antenna 40 of FIG. 5. In the example of FIG. 6, parasitic elements 108-1 and 108-2 and dielectric substrate 120 are not shown for the sake of clarity. As shown in FIG. 6, patch 106-1 and patch 106-2 of antenna 40 may be symmetrically distributed about central (lateral) axis 137 (e.g., patch 106-2 may be identical to patch 106-1 but mirrored about axis 137). Patches 106-1 and 106-2 may both have a width W perpendicular to length D1. Width W may, for example, be approximately equal to length D1 (e.g., patches 106-1 and 106-2 may have square outlines). Width W and length D1 of patches 106-1 and 106-2 may be approximately equal to one half of the wavelength of operation of antenna 40 or less by a factor determined by the dielectric constant of substrate 120.

Terminal 136-1 may be coupled to patch 106-1 at a first end (side) of patch 106-1 (e.g., the side of patch 106-1 closest to axis 137 and patch 106-2). Terminal 136-2 may be coupled to patch 106-1 at a first end (side) of patch 106-2 (e.g., the side of patch 106-2 closes to axis 137 and patch 106-1). Patch 106-1 may include impedance matching notches 132-1 on either side of terminal 136-1. Patch 106-2 may include impedance matching notches 132-2 on either side of terminal 136-2. Notches 132-1 may define leg 130-1 of patch 106-1. Notches 132-2 may define leg 130-2 of patch 106-2. Notches 132-1 may serve to adjust the impedance of patch 106-1 to match the impedance of vertical conductor 110-1 and transmission line 64. Notches 132-2 may serve to adjust the impedance of patch 106-2 to match the impedance of vertical conductor 110-2 and transmission line 64. Antenna signals may be conveyed to and from patches 106-1 and 106-2 via vertical conductors 110-1 and 110-2 and the same feed terminal 96 coupled to transmission line 64 (FIG. 5). Currents I corresponding to the antenna signals may flow over patch 106-1 through terminal 136-1 and leg 130-1. Currents I' corresponding to the antenna signals may flow over patch 106-2 through terminal 136-2 and leg 130-2 (e.g., in a direction opposite to currents I in patch 106-1).

Currents I may be identical to currents I' (e.g., because both currents are conveyed over the same feed terminal 96). However, currents I may be 180 degrees out of phase with currents I' (e.g., because patches 106-1 and 106-2 are symmetrically distributed about axis 137 and currents I flow through terminal 136-1 and over patch 106-1 in a direction opposite to currents I' flowing through terminal 136-2 and patch 106-2). Currents I and I' may generate (or be generated by) corresponding wireless signals (e.g., wireless signals at frequencies between 10 GHz and 300 GHz such as wireless millimeter wave signals) conveyed by antenna 40. The phase difference between currents I and I' and the symmetric geometry of patches 106-1 and 106-2 may, for example, configure antenna 40 to exhibit a wider radiation pattern than would otherwise be achievable by other patch antennas (e.g., patch antennas formed from a single patch having sides that are as long as the wavelength of operation). The example of FIG. 6 is merely illustrative. Patches 106-1 and 106-2 may other shapes (e.g., shapes with curved and/or straight edges) or orientations if desired. Terminal 136-1 may be coupled to patch 106-1 at the side of patch 106-1 closest to patch 106-2 (e.g., terminal 136-1 may be coupled to patch 106-1 exactly at the edge of patch 106-1 or may be offset from the edge by a margin such as at a location on arm 130-1 while still being considered to be coupled to patch 106-1 at the side closest to patch 106-2). Similarly, terminal 136-2 may be coupled to patch 106-2 at the side of patch 106-2 closest to patch 106-1 (e.g., terminal 136-2 may be coupled to patch 106-2 at the exact edge of patch 106-1 or may be offset from the edge by a margin such as at a location on arm 130-2 while still being considered coupled to patch 106-2 at the side closest to patch 106-1).

Figure 7:
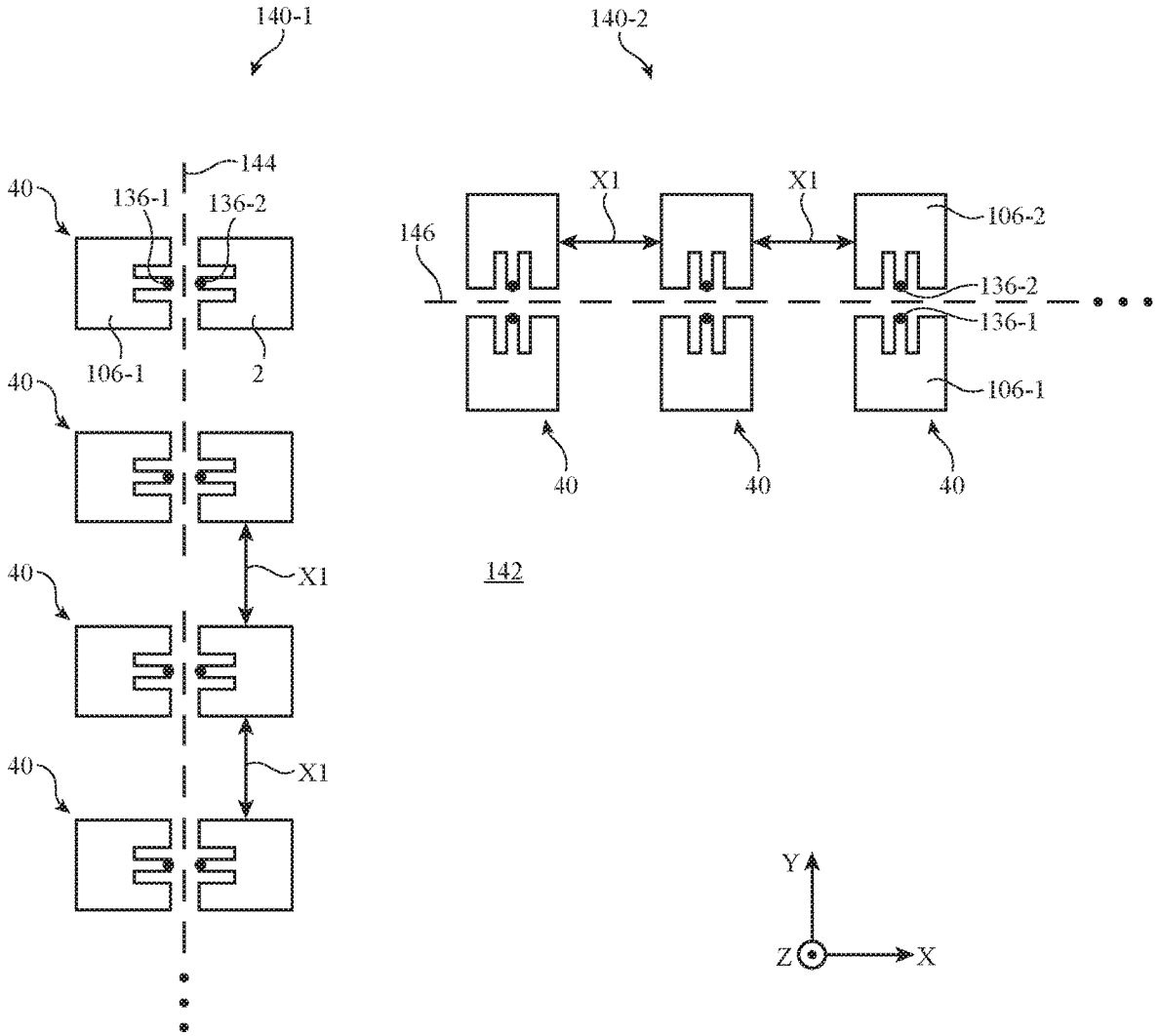
FIG. 7 is a top-down view of an illustrative array of antennas of the type shown in FIGS. 5 and 6 in accordance with an embodiment.

If desired, multiple antennas 40 of the type shown in FIGS. 5 and 6 may be arranged in an array such as a phased antenna array. FIG. 7 is a top-down diagram showing how multiple antennas 40 of the type shown in FIGS. 5 and 6 may be arranged in an array. As shown in FIG. 7, multiple antennas 40 may be arranged in a first one-dimensional array 140-1. Each antenna 40 in array 140-1 may be symmetrically distributed about vertical axis 144 (e.g., axis 137 as shown in FIG. 6). Each antenna 40 in array 140-1 may be separated from one or two adjacent antennas 40 in array 140-1 by distance X1. Distance X1 may be equal to or greater than length D1 and/or width W. For example, distance X1 may be approximately equal to half of the wavelength of operation of antennas 40 in free space (e.g., distance X1 may be greater than length D1 in scenarios where antennas 40 are formed on a substrate 120 having a dielectric constant greater than 1.0 that reduces length D1 to less than half of the wavelength of operation).

Each antenna 40 in array 140-1 may exhibit a single (e.g., linear) polarization. Array 140-1 may therefore also exhibit the same, single polarization. If desired, the number of polarizations covered by device 10 may be increased (e.g., to enhance polarization diversity for wireless circuitry 34) by arranging multiple antennas 40 in an additional one-dimensional array such as array 140-2 that is rotated at a non-parallel angle with respect to array 140-1. In the example of FIG. 7, each antenna 40 in array 140-2 is symmetrically distributed about horizontal axis 146. Axis 146 may be rotated at a non-parallel angle such as 90 degrees with respect to axis 144 of array 140-1. Each antenna 40 in array 140-2 may be separated from one or two adjacent antennas 40 in array 140-2 by distance X1.

Because each antenna 40 in array 140-2 is rotated 90 degrees with respect to the antennas in array 140-1, each antenna 40 in array 140-2 and thus array 140-2 itself may cover an additional polarization that is orthogonal to the polarization of array 140-1. In this way, wireless circuitry 34 may cover two orthogonal linear polarizations using multiple antennas 40 arranged in multiple one-dimensional arrays such as arrays 140-1 and 140-2. Control circuitry 14 (FIG. 2) may, if desired, control phase shifter and amplifier circuitry coupled to each antenna in array 140-1 and/or array 140-2 to perform beam steering operations using arrays 140-1 and/or 140-2 (e.g., arrays 140-1 and 140-2 may collectively form a single larger array that covers multiple linear polarizations).

If desired, arrays 140-1 and 140-2 may both be formed on the same substrate 142 (e.g., a stacked substrate such as substrate 120 of FIG. 5). The example of FIG. 7 is merely illustrative. If desired, multiple vertical arrays 140-1 and/or multiple horizontal arrays 140-2 may be arranged on substrate 142 (e.g., to form a larger array that includes any desired number of one-dimensional arrays 140-1 and 140-2). Antennas 40 may be arranged in other patterns if desired. Antennas 40 may be arranged in the same array with other types of antennas or other antennas having different structures or architectures if desired.

Figure 8:
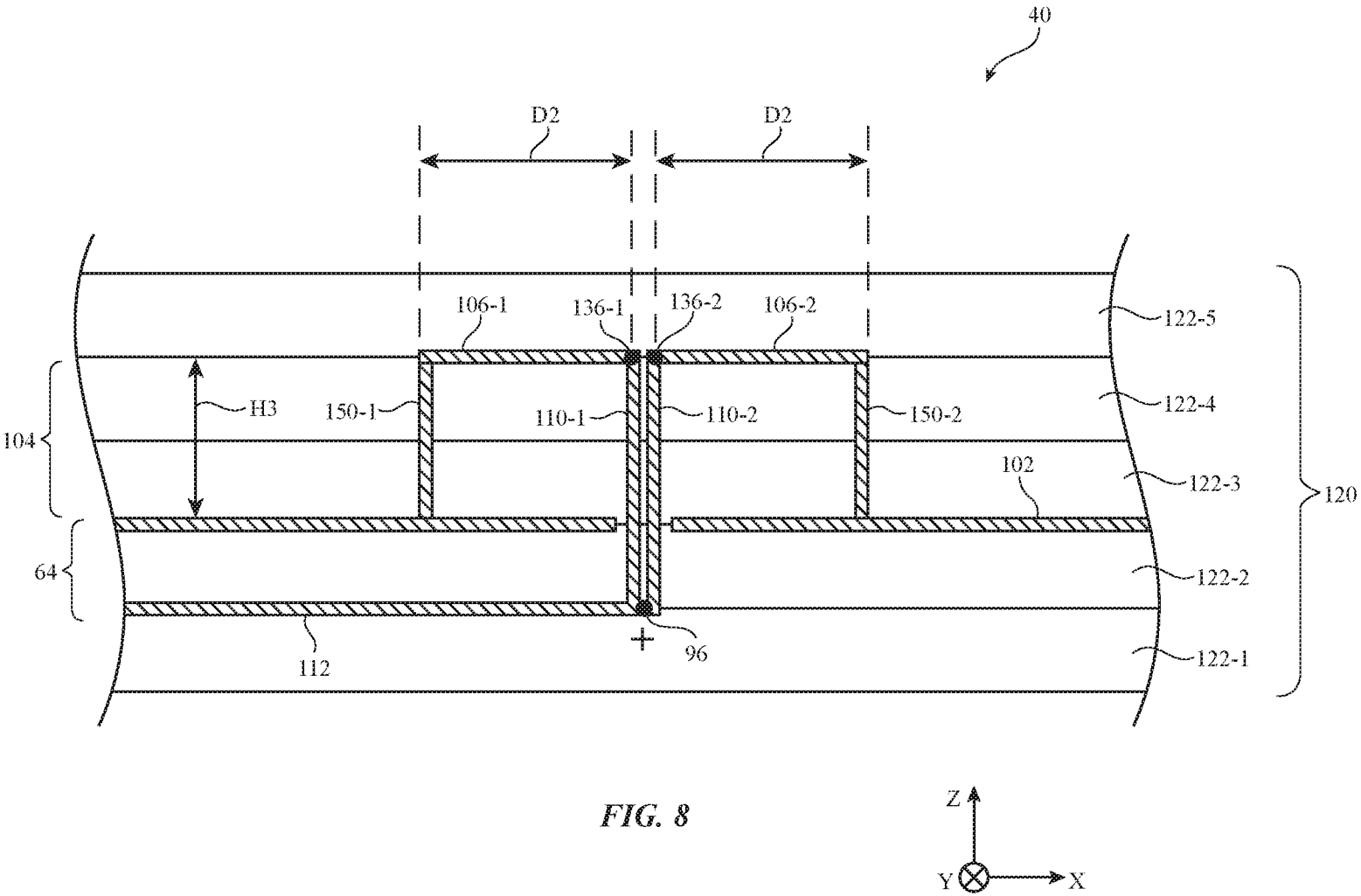
FIG. 8 is a cross-sectional side view of an illustrative antenna having a resonating element with dual patches that are fed over a single feed terminal and shorted to ground in accordance with an embodiment.

If desired, patches 106 of antenna 40 may be shorted to ground 102 (e.g., patches 106 may be folded downwards to short and end of the patches to ground 102). This may serve to further widen the spatial radiation pattern of antenna 40 and to reduce the lateral footprint of antennas 40, for example. FIG. 8 is a cross-sectional side view of antenna 40 having patches 106 that are shorted to ground 102.

As shown in FIG. 8, patches 106-1 and 106-2 may be formed on a surface of dielectric layer 122-4 or another dielectric layer in substrate 120. Resonating element 104 may include vertical conductive structures 150-1 coupled between the end of patch 106-1 opposing terminal 136-1 and ground 102. Similarly, resonating element 104 may include vertical conductive structures 150-2 coupled between the end patch 106-2 opposing terminal 136-2 and ground 102 (e.g., structures 150-1 may short an end of patch 106-1 to ground 102 whereas structures 150-2 short an end of patch 106-2 to ground 102). Vertical conductive structures 150-1 may include one or more conductive vias extending through substrate 120 (e.g., through layers 122-4 and 122-3 to ground 102). Vertical conductive structures 150-2 may include one or more conductive vias extending through substrate 120 (e.g., through layers 122-4 and 122-3 to ground 102). Patches 106-1 and 106-2 may be formed at a distance H3 above ground plane 102 in this example (e.g., vertical conductive structures 150-1 and 150-2 may each have a length H3).

When configured in this way, patch 106-1 and patch 106-2 may each have a lateral length D2 that is less than length D1 of FIGS. 5 and 6. Length D2 may, for example, be approximately equal to distance H3. Length D2 and distance H3 may, for example, each be approximately equal to one quarter of the wavelength of operation of antenna 40 or one quarter of the wavelength of operation divided by the square root of the dielectric constant of substrate 120 (e.g., length D2 and length H3 may be inversely proportional to the dielectric constant of substrate 120).

Antenna signals may be conveyed for antenna 40 over transmission line 64. Corresponding antenna currents may flow through feed terminal 96, conductor 110-1, patch 106-1, and may be shorted to ground 102 over path 150-1. Similarly, antenna currents may flow through feed terminal 96, conductor 110-2, patch 106-2, and may be shorted to ground 102 over path 150-2. Redistributing a portion of the antenna currents over vertical conductors 150-1 and 150-2 in this way may, for example, serve to pull some of the radiation pattern of antenna 40 towards ground 102, thereby widening the coverage of antenna 40 relative to the arrangement of FIGS. 5 and 6. Similarly, distributing the resonating length of antenna 40 across patches 106-1 and 106-2 and vertical conductors 150-1 and 150-2 may serve to reduce the lateral length of patches 106-1 and 106-2 (e.g., from length D1 to length D2) and thus the overall lateral footprint of antenna 40 relative to the arrangement of FIGS. 5 and 6. This may, for example, serve to reduce the amount of space required to form antenna 40 within device 10 relative to the arrangement of FIGS. 5 and 6.

Figure 9:
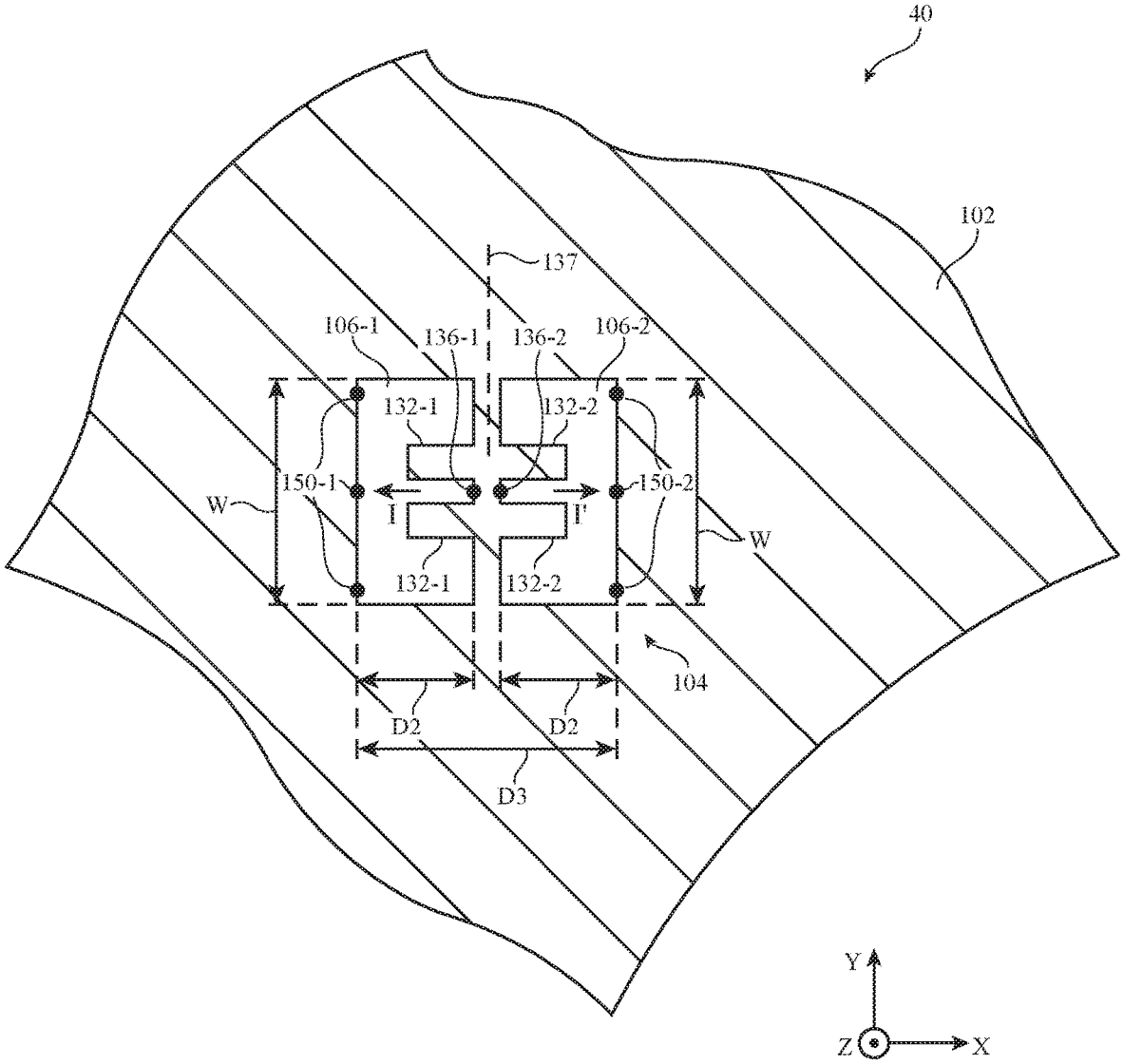
FIG. 9 is a top-down view of an illustrative antenna having a resonating element with dual patches that are fed over a single feed terminal and shorted to ground in accordance with an embodiment.

Conductive patches 106-1 and 106-2 may be formed from conductive (metal) traces on the corresponding layers 122 of substrate 120. The example of FIG. 9 is merely illustrative. If desired, additional layers 122 may be interposed between traces 112 and 102 and/or additional or fewer layers 122 may be interposed between traces 102 and traces 106. If desired, parasitic elements 108 such as elements 108-1 and 108-2 may be formed over patches 106-1 and 106-2 in the arrangement of FIG. 9 (e.g., on a surface of layer 122-5). In another suitable arrangement, substrate 120 may be formed from a single dielectric layer (e.g., antennas 40 may be embedded within a single dielectric layer such as a molded plastic layer). In yet another suitable arrangement, substrate 120 may be omitted and antenna 40 may be formed on other substrate structures or may be formed without substrates. In these scenarios, patches 106 and/or ground plane 102 may be formed from stamped sheet metal, metal foil, electronic device housing structures, or other conductive structures and vertical structures 150-1 and 150-2 may be formed from metal pillars, metal wires, conductive pins, other conductive structures, or integral portions of patches 106 that are folded downwards and shorted to ground 102 using solder, welds, conductive adhesive, or other conductive interconnect structures.

Figure 10:
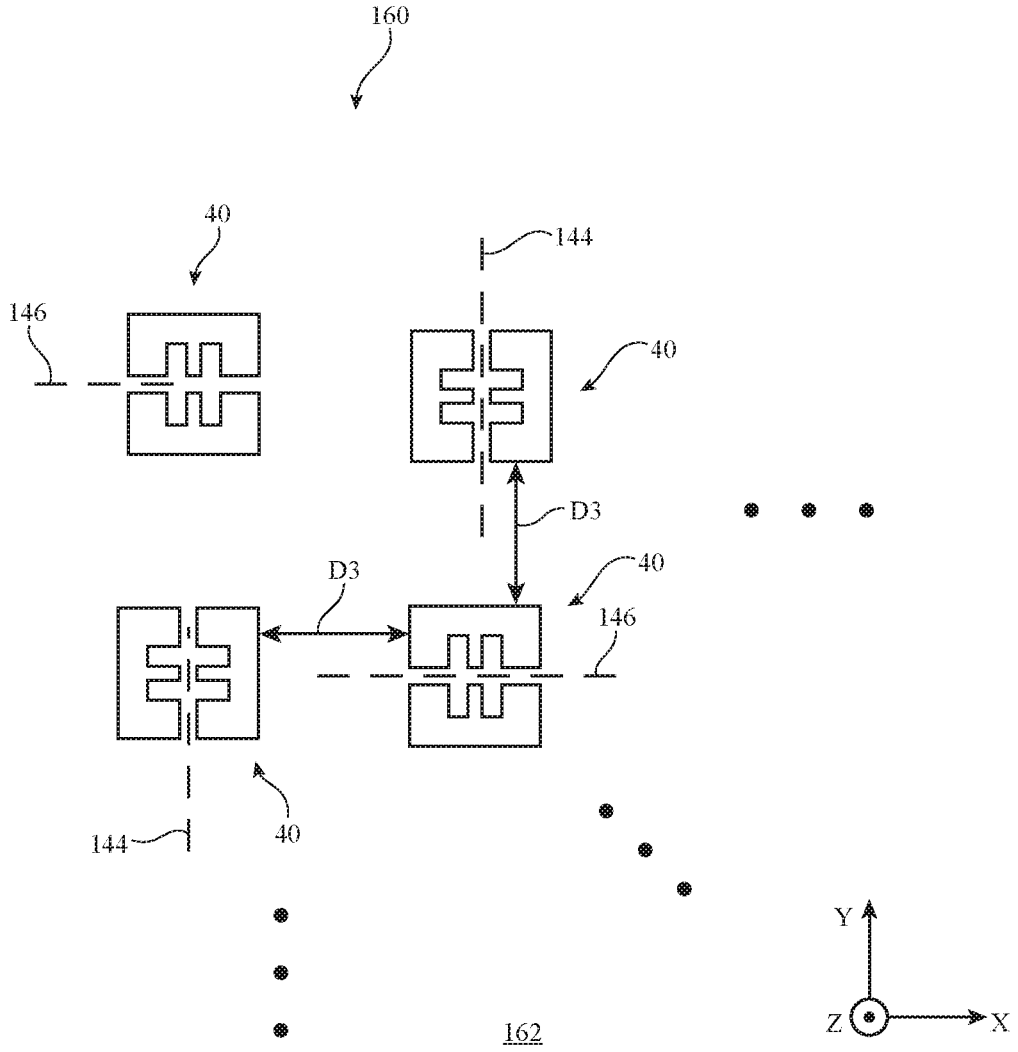
FIG. 10 is a top-down view of an illustrative array of antennas of the type shown in FIGS. 8 and 9 in accordance with an embodiment.

FIG. 10 is a top-down view of antenna 40 of FIG. 9 having patches 106 that are shorted to ground 102. In the example of FIG. 6, dielectric substrate 120 is not shown for the sake of clarity. As shown in FIG. 6, patches 106-1 and 106-2 may both have a width W and a length D2 that is greater than width W (e.g., patches 106-1 and 106-2 may have rectangular outlines). Width W may, for example, be approximately equal to one half of the wavelength of operation of antenna 40 or less by a factor determined by the dielectric constant of substrate 120. Length D2 may, for example, be approximately equal to one quarter of the wavelength of operation of antenna 40 or less by the factor determined by the dielectric constant of substrate 120 (e.g., length D2 may be approximately half width W).

In the example of FIG. 9, three vertical conductive structures 150-1 (e.g., three conductive vias) are used to short patch 106-1 to ground 102 and three conductive structures 150-2 are used to short patch 106-2 to ground 102. This is merely illustrative. If desired, one, two, or more than three conductive structures 150-1 may be used to short patch 106-1 to ground 102 and one, two, or more than three conductive structures 150-2 may be used to short patch 106-2 to ground 102. In another suitable arrangement (e.g., in scenarios where dielectric 120 is omitted or confined to the space between conductors 150-1 and 150-2), vertical conductive structure 150-1 may be a single piece of metal extending across width W and between patch 106-1 and ground 102 and vertical conductive structure 150-2 may be a single piece of metal extending across width W and between patch 106-2 and ground 102. In this scenario, vertical conductive structure 150-1 and patch 106-1 may be formed from a single bent or folded piece of metal and vertical conductive structure 150-2 and patch 106-2 may be formed from a single bent or folded piece of metal.

When arranged in this way, resonating element 104 of antenna 40 may have a smaller lateral footprint (e.g., as defined by dimensions W and D2) than the arrangement of FIGS. 5 and 6. Antenna signals may be conveyed to and from patches 106-1 and 106-2 via vertical conductors 110-1 and 110-2 and the same feed terminal 96 coupled to transmission line 64 (FIG. 9). Currents I corresponding to the antenna signals may flow over patch 106-1 through terminal 136-1 and leg 130-1. Currents I may flow over patch 106-1 and may be shorted to ground 102 over conductive structures 150-1. Currents I' corresponding to the antenna signals may flow over patch 106-2 through terminal 136-2 and leg 130-2 (e.g., in a direction opposite to currents I in patch 106-1). Currents I' may flow over patch 106-2 and may be shorted to ground 102 over conductive structures 150-2.

The phase difference between currents I and I' and the symmetric geometry of patches 106-1 and 106-2 and conductive structures 150-1 and 150-2 may, for example, configure antenna 40 to exhibit a wider radiation pattern than would otherwise be achievable by other patch antennas (e.g., patch antennas formed from a single patch having sides that are as long as the wavelength of operation). Distributing some of currents I and I' over vertical conductive structures 150-1 and 150-2, respectively, may serve to further widen the radiation pattern of antenna 40 relative to the arrangement of FIGS. 5 and 6. The example of FIG. 9 is merely illustrative. Patches 106-1 and 106-2 may other shapes (e.g., shapes with curved and/or straight edges) or orientations if desired.

If desired, multiple antennas 40 of the type shown in FIGS. 8 and 9 may be arranged in an array such as a phased antenna array. FIG. 10 is a top-down diagram showing how multiple antennas 40 of the type shown in FIGS. 8 and 9 may be arranged in an array. As shown in FIG. 10, multiple antennas 40 may be arranged in a two-dimensional array 160 (e.g., an array having rows and columns). Each antenna 40 in array 160 may be separated from the adjacent antennas 40 in array 160 by distance D3. Distance D3 may be greater than or equal to length D1, width W, or twice length D2. For example, distance D3 may be approximately equal to half of the wavelength of operation of antennas 40 in free space (e.g., distance D3 may be greater than length D1 in scenarios where antennas 40 are formed on a substrate 120 having a dielectric constant greater than 1.0 that reduces length D1 to less than half of the wavelength of operation).

Array 160 may include alternating antennas 40 oriented about vertical axes 144 and antennas 40 oriented about horizontal axes 146 (e.g., horizontally-oriented antennas 40 may be located in the odd numbered columns of the odd numbered rows of array 160 and in the even numbered columns of the even numbered rows of array 160 whereas vertically-oriented antennas 40 may be located in the odd numbered columns of the even numbered rows of array 160 and in the even numbered columns of the odd numbered rows of array 160).

The horizontally-oriented antennas 40 in array 160 may cover a first linear polarization and the vertically-oriented antennas 40 in array 160 may cover a second linear polarization orthogonal to the first polarization. When configured in this way, array 160 may cover both polarizations for polarization diversity. Each antenna 40 in array 160 may occupy less lateral space than antennas 40 in arrays 140 of FIG. 7 and array 160 may occupy less lateral area than arrays 140 of FIG. 7, for example. Control circuitry 14 (FIG. 2) may, if desired, control phase shifter and amplifier circuitry coupled to each antenna in array 160 to perform beam steering operations using the antennas of array 160.

If desired, each antenna 40 in array 160 may be formed on the same substrate 162 (e.g., a stacked substrate such as substrate 120 of FIG. 8). The example of FIG. 10 is merely illustrative. If desired, array 160 may include any desired number of vertically-oriented antennas 40 and horizontally-oriented antennas 40 arranged in any desired pattern (e.g., antennas 40 need not be arranged in a grid of rows and columns). Antennas 40 in array 160 may be formed on different substrates if desired. Array 160 may include additional antennas of other types or architectures if desired.

Figure 11:
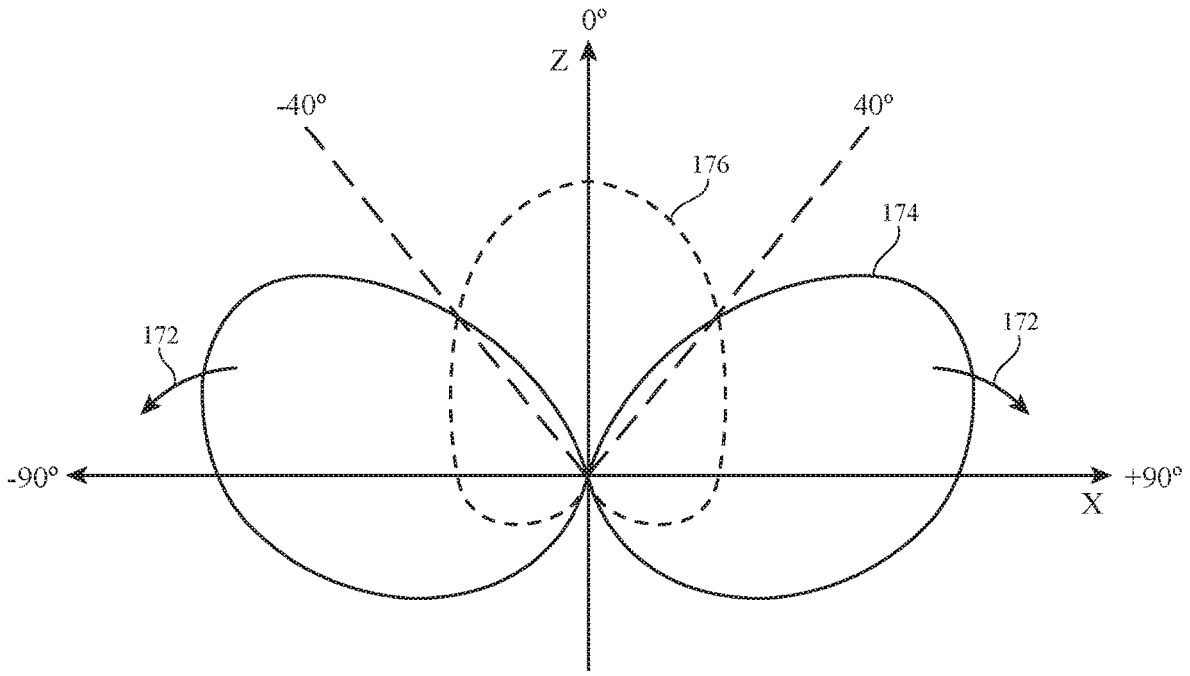
FIG. 11 is a diagram showing an illustrative radiation pattern for antennas of the type shown in FIGS. 5-10 in accordance with an embodiment.

FIG. 11 is a cross-sectional diagram of an exemplary radiation pattern that may be exhibited by antenna 40 (e.g., where the lateral surfaces of patches 106 lie in the X-Y plane of FIG. 11). Curve 176 may represent the radiation pattern of a patch antenna having a resonating element with a single conductive patch and sides with lengths equal to the wavelength of operation. As shown in FIG. 11, curve 176 exhibits relatively strong coverage (e.g., relatively high gain) at angles between about +40 degrees and −40 degrees. However, curve 176 exhibits relatively low gain at angles between +40 degrees and +90 degrees and at angles between −40 degrees and −90 degrees. As such, an antenna corresponding to pattern 176 may provide insufficient coverage (e.g., may exhibit relatively low gain) when communicating with external communications equipment located around +90 and −90 degrees with respect to the antenna.

Curve 174 may represent the radiation pattern of antenna 40 of the type shown in FIGS. 5-10. As shown in FIG. 11, radiation pattern 174 exhibits relatively strong coverage at angles between +40 degrees and +90 degrees and at angles between −40 degrees and −90 degrees. Shorting patches 106 to ground 102 (e.g., in the arrangement of FIGS. 8-10) may serve to further widen the radiation pattern of antenna 40, as shown by arrows 172 (e.g., because the antenna currents also flow down vertical conductors 150-1 and 150-2 to ground 102 in this scenario). In other words, antenna 40 may provide improved coverage at wider angles such as angles between +40 degrees and +90 degrees and angles between −40 degrees and −90 degrees relative to other patch antennas, thereby allowing device 10 to communicate with external communications equipment located at relatively wide angles with respect to antenna 40 (e.g., with satisfactory link quality). Other types of antennas may be formed in the same array (e.g., array 160 of FIG. 10 or arrays 140 of FIG. 7) as antennas 40 of the types shown in FIGS. 5-10 in order to further enhance coverage for wireless circuitry 34 around 0 degrees, if desired.

The example of FIG. 11 is merely illustrative and, if desired, curve 174 may have other shapes. As shown in FIG. 11, curve 174 illustrates the cross-sectional radiation pattern of antenna 40. However, in general, curve 174 may be rotated around the Z-axis to give a full three-dimensional pattern for the antenna.

The foregoing is merely illustrative and various modifications can be made by those skilled in the art without departing from the scope and spirit of the described embodiments. The foregoing embodiments may be implemented individually or in any combination.

What is claimed is:

1. A millimeter wave antenna, comprising:

a ground plane;

first and second conductive patches separated from the ground plane by a height and distributed symmetrically about an axis; and an antenna feed having a first feed terminal formed at a conductive trace, coupled to the first and second conductive patches, and configured to convey antenna signals for both the first and second conductive patches, and a second feed terminal coupled to the ground plane, wherein the ground plane is interposed between the conductive trace and the first conductive patch, the ground plane has an opening, the first feed terminal is directly coupled to the first conductive patch using a first conductive structure that extends through the opening, and the first feed terminal is directly coupled to the second conductive patch using a second conductive structure that extends through the opening.

2. The millimeter wave antenna defined in claim 1, wherein first conductive patch is configured to convey a first antenna current and the second conductive patch is configured to convey a second antenna current that is 180 degrees out of phase with respect to the first antenna current.

3. The millimeter wave antenna defined in claim 1, further comprising:

a transmission line having a positive signal conductor coupled to the first feed terminal and a ground conductor that includes a portion of the ground plane.

4. The millimeter wave antenna defined in claim 3, wherein the first conductive structure is coupled to a first point at a first end of the first conductive patch, the second conductive structure is coupled to a second point at a first end of the second conductive patch, the first conductive patch has a second end that is separated from the first end of the first conductive patch by a given distance, and the second conductive patch has a second end that is separated from the first end of the second conductive patch by the given distance.

5. The millimeter wave antenna defined in claim 4, wherein the first end of the first conductive patch is interposed between the first end of the second conductive patch and the second end of the first conductive patch.

6. The millimeter wave antenna defined in claim 5, wherein the first conductive patch has third and fourth sides that extend between the first and second ends of the first conductive patch and that are separated by the given distance, and the second conductive patch has third and fourth sides that extend between the first and second ends of the second conductive patch and that are separated by the given distance.

7. The millimeter wave antenna defined in claim 5, further comprising:

first impedance matching notches in the first conductive patch that are configured to match an impedance of the first conductive patch with an impedance of the first conductive structure; and second impedance matching notches in the second conductive patch that are configured to match an impedance of the second conductive patch with an impedance of the second conductive structure.

8. The millimeter wave antenna defined in claim 5, further comprising:

a third conductive structure that shorts the second end of the first conductive patch to the ground plane; and a fourth conductive structure that shorts the second end of the second conductive patch to the ground plane.

9. The millimeter wave antenna defined in claim 5, further comprising:

a first parasitic antenna resonating element, wherein the first conductive patch is interposed between the first parasitic antenna resonating element and the ground plane; and a second parasitic antenna resonating element, wherein the second conductive patch is interposed between the second parasitic antenna resonating element and the ground plane.

10. The millimeter wave antenna defined in claim 1, comprising:

a stacked dielectric substrate having a first layer, a second layer, and a third layer, the second layer being interposed between the first and third layers, metal traces on the second layer forming the ground plane, and metal traces on the third layer forming the first and second conductive patches, wherein the first conductive structure extends through the second and third layers, and the second conductive structure extends through the second and third layers.

11. The millimeter wave antenna defined in claim 10, wherein the first conductive patch has opposing first and second sides, the second conductive patch has opposing first and second sides, the first conductive structure is coupled to a first point at the first side of the first conductive patch, the second conductive structure is coupled to a second point at the first side of the second conductive patch, and the first side of the first conductive patch is interposed between the second side of the first conductive patch and the first side of the second conductive patch.

12. The millimeter wave antenna defined in claim 11, further comprising:

a third conductive structure coupled between the second side of the first conductive patch and the ground plane; and a fourth conductive structure coupled between the second side of the second conductive patch and the ground plane.

13. The millimeter wave antenna defined in claim 10, wherein the stacked dielectric substrate has a fourth layer, the third layer is interposed between the second and the fourth layers, and the millimeter wave antenna further comprises:

metal traces on the fourth layer that form a first parasitic antenna resonating element for the first conductive patch and a second parasitic antenna resonating element for the second conductive patch.

14. The millimeter wave antenna defined in claim 1, wherein the first conductive patch has a length and a width, the second conductive patch has the length and the width, the first conductive patch has a first side closest to the second conductive patch, the second conductive patch has a second side closest to the first conductive patch, the first feed terminal is coupled to the first conductive patch at the first side of the first conductive patch and coupled to the second conductive patch at the second side of the second conductive patch.

15. The millimeter wave antenna defined in claim 1, wherein the first conductive patch has first and second opposing edges, the first edge being interposed between the second edge and the second conductive patch, and the second conductive patch has third and fourth opposing edges, the third edge being interposed between the fourth edge and the first conductive patch, the first conductive structure directly coupling the first feed terminal to the first edge, and the second conductive structure directly coupling the second feed terminal to the third edge.

16. An electronic device, comprising:

a ground plane for an antenna;

first and second conductive patches for the antenna that are separated from the ground plane by a height and distributed symmetrically about an axis; and an antenna feed for the antenna having a first feed terminal formed at a conductive trace, coupled to the first and second conductive patches, and configured to convey antenna signals for both the first and second conductive patches, and a second feed terminal coupled to the ground plane, wherein the ground plane is interposed between the conductive trace and the first conductive patch, the ground plane has an opening, the first feed terminal is directly coupled to the first conductive patch using a first conductive structure that extends through the opening, and the first feed terminal is directly coupled to the second conductive patch using a second conductive structure that extends through the opening.

* * * * *